US008358190B1

(12) United States Patent
Hoff et al.

(10) Patent No.: US 8,358,190 B1
(45) Date of Patent: Jan. 22, 2013

(54) PERMANENT MAGNET STRUCTURE FOR PRODUCING A UNIFORM AXIAL MAGNETIC FIELD

(75) Inventors: Brad W. Hoff, Albuquerque, NM (US); Peter J. Mardahl, Albuquerque, NM (US); Christina H. Chen, Niskayuna, NY (US); John C. Horwath, Kettering, OH (US); Michael D. Haworth, Sandia Park, NM (US)

(73) Assignee: The United States of America as Represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 13/245,374

(22) Filed: Sep. 26, 2011

(51) Int. Cl.
*H01F 7/02* (2006.01)

(52) U.S. Cl. ..... 335/306

(58) Field of Classification Search ..... 335/216, 335/229, 285–287, 302, 306, 284
See application file for complete search history.

(56) References Cited

U.S. PATENT DOCUMENTS 3,768,054 A * 10/1973 Neugebauer ..... 335/304
4,654,618 A * 3/1987 Leupold ..... 335/304
4,764,743 A * 8/1988 Leupold et al. ..... 335/306
4,953,555 A * 9/1990 Leupold et al. ..... 600/421
5,126,713 A 6/1992 Leupold
5,422,618 A 6/1995 Leupold
5,438,308 A 8/1995 Leupold
5,635,889 A * 6/1997 Stelter ..... 335/306
5,886,609 A * 3/1999 Stelter ..... 335/306
7,715,166 B2 * 5/2010 Schultz et al. ..... 361/149

OTHER PUBLICATIONS

Tilak, Anu et al "Permanent Magnet Solenoids: A Catalog of Field Profiles", ARL-TR-1123, Sep. 1996.

* cited by examiner

*Primary Examiner* — Alexander Talpalatski
(74) *Attorney, Agent, or Firm* — James M. Skorich; Kenneth E. Callahan

(57) ABSTRACT

A wide aperture permanent magnet structure which is useful in creating a highly uniform longitudinal or solenoidal magnetic field in the working region of the magnet and in which the aperture of the structure can be equal in cross-sectional area to the working region of the magnet. The geometry and magnetization direction of the constituent magnets are chosen to maximize the uniformity of the longitudinal or solenoidal magnetic field in the working region of the magnet while minimizing the overall volume and weight of the structure as well as eliminating the need for magnetic pole pieces made of iron or other high permeability materials. The invention can take the form of a cylindrical shell of permanent magnets to create a solenoidal magnetic field, or a parallel surface arrangement to create a longitudinal magnetic field.

4 Claims, 7 Drawing Sheets

PERMANENT MAGNET STRUCTURE FOR PRODUCING A UNIFORM AXIAL MAGNETIC FIELD

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

The invention relates generally to permanent magnet structures, and in particular to new permanent magnet assemblies that do not require pole pieces restricting the aperture of the working region while producing compact solenoidal or longitudinal internal magnetic working fields.

Solenoidal and longitudinal magnetic fields are used extensively in the microwave tube and plasma physics communities in applications requiring the focusing and manipulation of charged particle trajectories. In the case of small microwave tubes, such as the kilowatt magnetrons used in microwave ovens, assembles of permanent magnets and high magnetic permeability pole pieces are commonly used to achieve the longitudinal field profiles required for operation of the device. Larger tubes, however, tend to employ the use of more massive wire solenoid coils or Helmholtz coil pairs in conjunction with bulky power supplies. The reliance on bulky coil-based magnets can be undesirable in cases where overall system compactness is a necessity as well as in cases with limited electrical power budgets.

By using magnetically rigid, high energy-product magnetic materials such as the rare earth magnets Neodymium-Iron-Boron or Samarium-Cobalt, it is feasible to build compact magnetic structures that generate a solenoidal or longitudinal magnetic field within the desired working region of the magnet assembly. Previous work by Tilak, et al., "Permanent Magnet Solenoids: A Catalog of Field Profiles," ARL-TR-1123, Sept. 1996, as well as U. S. Pat. Nos. 5,126,713, 5,422,618, and 5,438,308 demonstrate examples of permanent magnet solenoids with a variety of working volume diameter to length aspect ratios. Unfortunately, in all of these configurations, the entrance apertures to the working region of the solenoid is either partially or completely blocked by the existence of magnetic pole pieces or cladding magnet arrays. This is most undesirable in cases requiring quick change-out of a microwave tube where one does not wish to disassemble or move the magnet or vice versa. This is also problematic for cases of devices with a constant or nearly constant cross-sectional area throughout in which magnetization is desired in only one finite section.

In the present invention, it was discovered that by properly choosing the shape and magnetization direction of permanent magnet assemblies, a solenoidal or longitudinally-directed magnetic field could be generated in the working region of a permanent magnet solenoid without the need for pole pieces or cladding magnet assemblies that completely or partially block the entrance aperture of the working region. The present invention fulfills the need for a compact method to generate a solenoidal or longitudinally-directed magnetic field in a given volume without the requirement of electrical power or magnetic pole pieces, and provides the ability to use an entrance aperture of the same cross-sectional area as that of the working volume of the magnet.

SUMMARY

The present invention provides a wide aperture permanent magnet structure that generates longitudinal or solenoidal internal magnetic working fields without the need for iron or other high magnetic permeability passive pole pieces at each end of the array or the need for external electrical power. The entrance aperture of the magnet array may be equal in cross-sectional area to the open volume within the magnet array. The cross-sectional area of this aperture is perpendicular to the longitudinal direction. The field strength within the working volume has a high degree of uniformity. These magnet structures can be used to confine or manipulate the trajectories of charged particles in microwave tubes and in plasma physics applications.

The structure is an arrangement of layered permanent magnets of varying geometry and magnetic vector alignment forming either a cylindrical shell (solenoidal field) or two parallel surfaces (longitudinal field). The cross-sectional area of the layered permanent magnets consists of a polyhedral or rounded base magnet with an outer layer of polyhedral or rounded cladding magnets. The inner surface of the base magnet is parallel to the longitudinal direction and forms the boundary of the inner volume of the magnet array, neglecting any magnetically inert coatings that may be used to line the inner volume of the magnet array. A unit consisting of a base magnet and associated cladding magnets may be sequentially repeated to form a longer solenoid, a toroid, or a longer parallel surface arrangement.

The magnetization of the base magnet is oriented along the longitudinal direction and in the direction opposite to that of the desired magnetic field within the working region of the solenoid or parallel surface arrangement, which is in stark contrast to prior permanent magnet arrangements. Because of this, there are no magnetic poles located on the boundary of the base magnet and the inner volume or working region of the magnet assembly. The magnetizations of the cladding magnets are directed in such a way to enhance the magnitude and uniformity of the longitudinal or solenoidal field within the working volume of the magnets. For manufacturability purposes, the base or cladding magnets may be comprised of smaller magnet segments, assuming that the magnetization directions of the small magnets forming the larger volumes, i.e., the base or cladding magnets, are all the same.

DESCRIPTION OF THE PREFERRED EMBODIMENT

Figure 1:
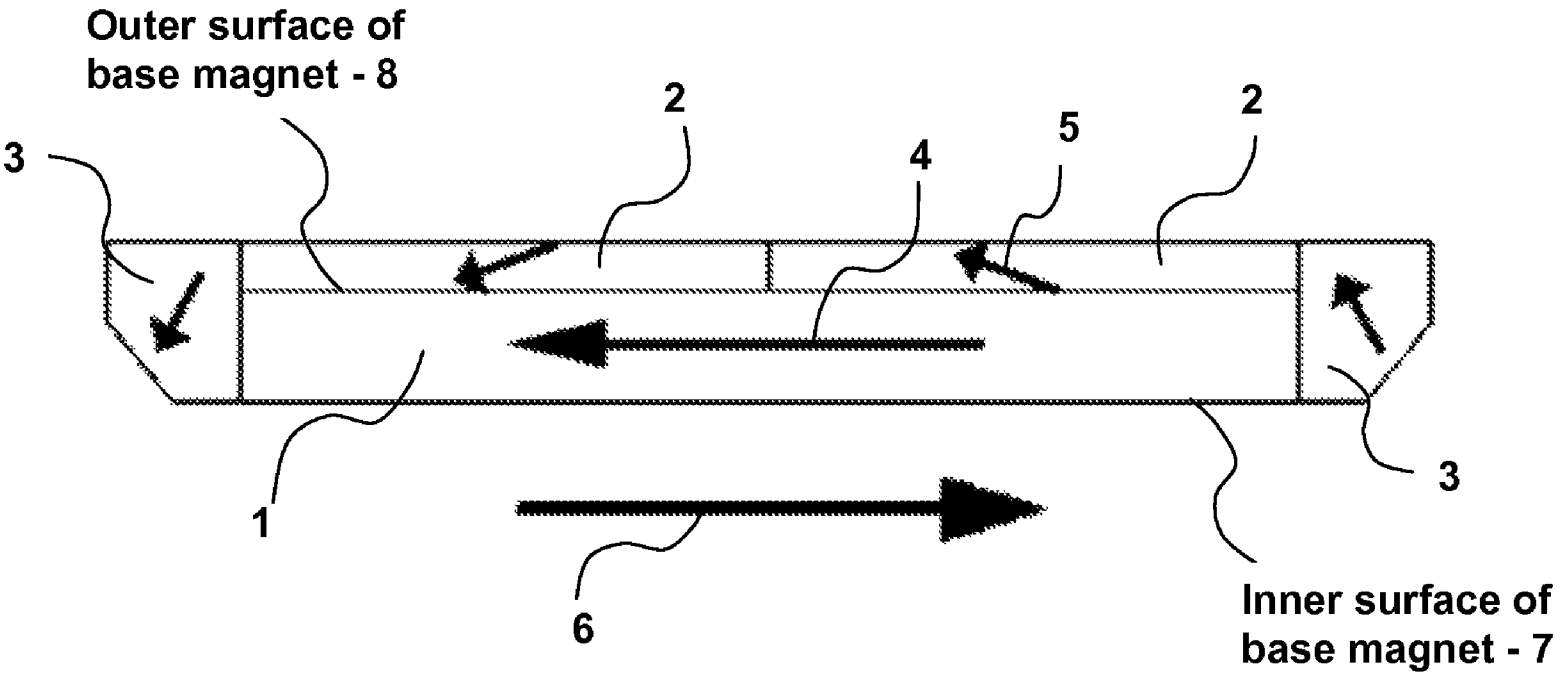
FIG. 1 is a schematic representation of a cross-section of one of the magnet assemblies comprising either a solenoidal or parallel surface magnet array.

The wide aperture permanent magnet structure is comprised of two or more subassemblies Each subassembly structure is an arrangement of layered permanent magnets of varying geometry and magnetic vector alignment. FIG. 1 is a cross-sectional view of one of the magnet subassemblies. The 3-dimensional base magnet 1 is rectangular in cross-section in the long dimension. The surfaces having the long dimension extend in the longitudinal direction and may be either flat or curved. The polarity of the base magnet is indicated by the arrow 4 along the longitudinal direction. The ends of the base magnet are flat. There is an inner long dimension surface 7 defined by a straight dimension in the longitudinal direction and a straight or curved perpendicular dimension to form a flat or curved surface. A similar outer long dimension surface 8 is similarly defined and would be parallel to the inner surface. One or more first cladding magnets 2 cover the outer long dimension surface and have a polarity in the same direction as the base magnet as indicated by the small arrows 5. Cladding magnets are additional magnets added to an existing magnetic structure for the purposes of enhancing magnetic flux confinement. The working region of the structure is parallel to the inner long dimension surface 8 of the base magnet with a polarity indicated by the arrow 6 opposite to that within the base magnet 4. The ends of the base and cladding magnets are capped by cladding magnets 3. These end cladding magnets 3 may have a rectangular cross-section or have a five-sided cross-section, being rectangular but having one corner beveled and directed toward the working region to provide additional magnetic field shaping to make the internal field in the working region smoother. They are otherwise straight or curved to match the ends of the base magnet and first cladding magnets.

Figure 2B:
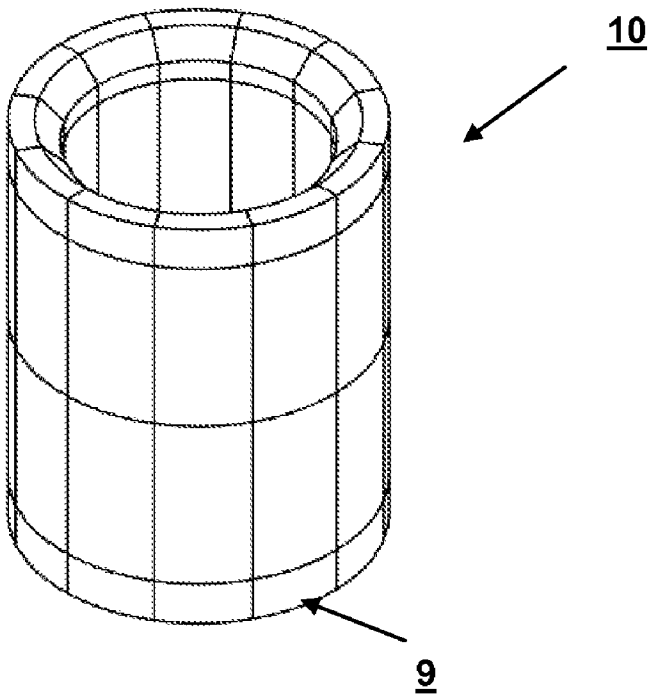
FIG. 2 is a perspective view of a magnet assembly created by rotating the cross-section of FIG. 1 through an arc (2*a*) and of a cylindrical shell (2*b*) comprised of these assemblies, thereby forming a permanent magnet solenoid.
Figure 2A:
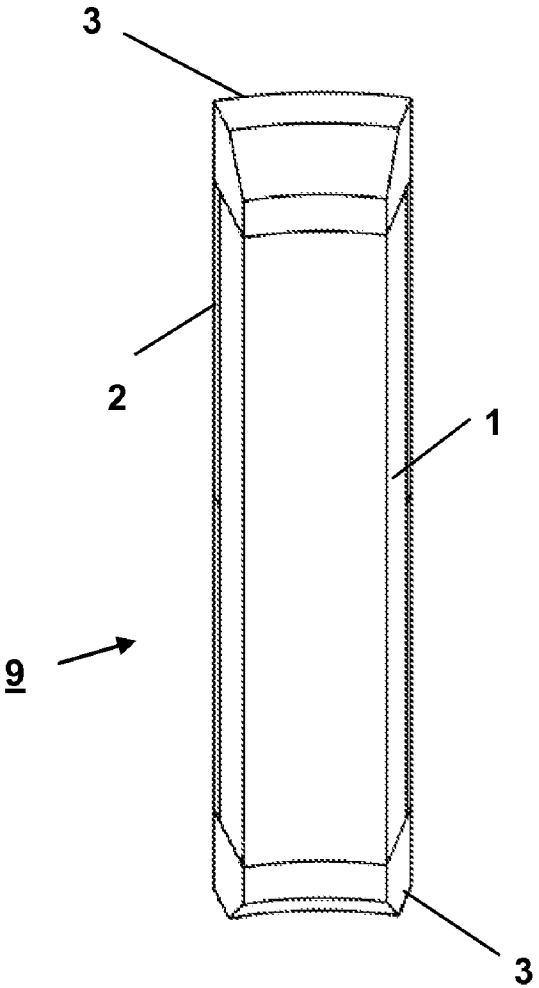
Figure 3:
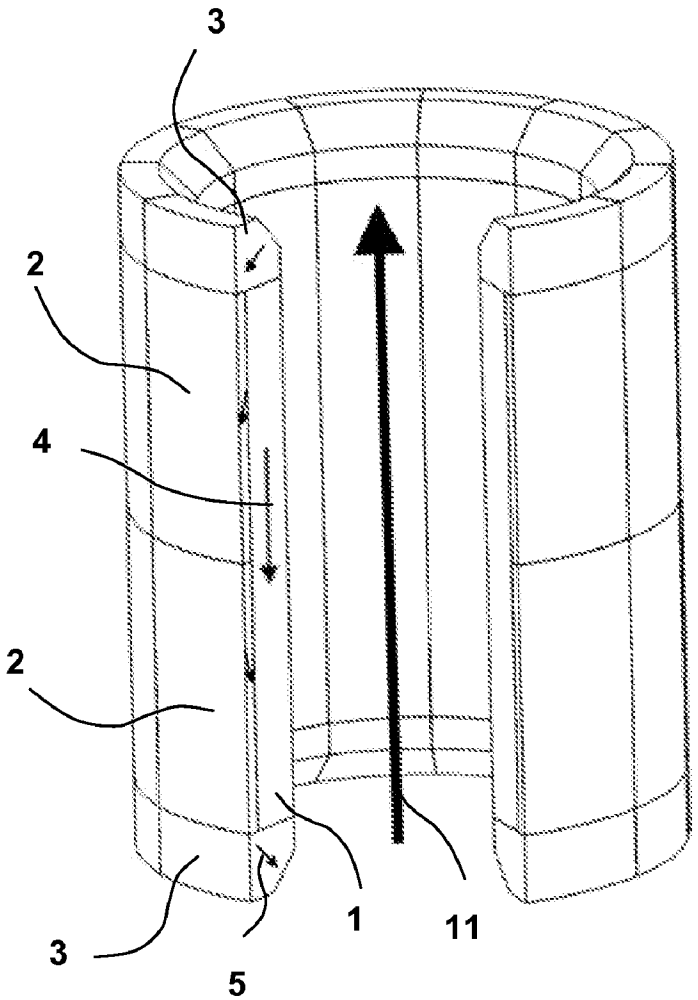
FIG. 3 is a perspective view of a portion of the cylindrical shell depicted in FIG. 2.

FIG. 2*a* depicts a three-dimensional magnet sub-assembly 9 created by rotating the cross-section of FIG. 1 through an arc. Visible in this assembly are the base magnet 1 and the cladding magnets 2, 3. A number of these sub-assemblies 9 can be combined into a hollow cylindrical shell (FIG. 2*b*) effectively creating a permanent magnet solenoid 10. A cutaway view of this hollow cylindrical shell is shown in FIG. 3. Using sub-assembly 9 as a representative for the other sub-assemblies comprising the cylindrical shell in FIG. 3, arrows 4, 5 representing the approximate magnetization directions for each of the magnets 1, 2, and 3 are shown, along with another arrow 11 representing the average direction of the longitudinally directed solenoidal magnetic field.

Figure 4:
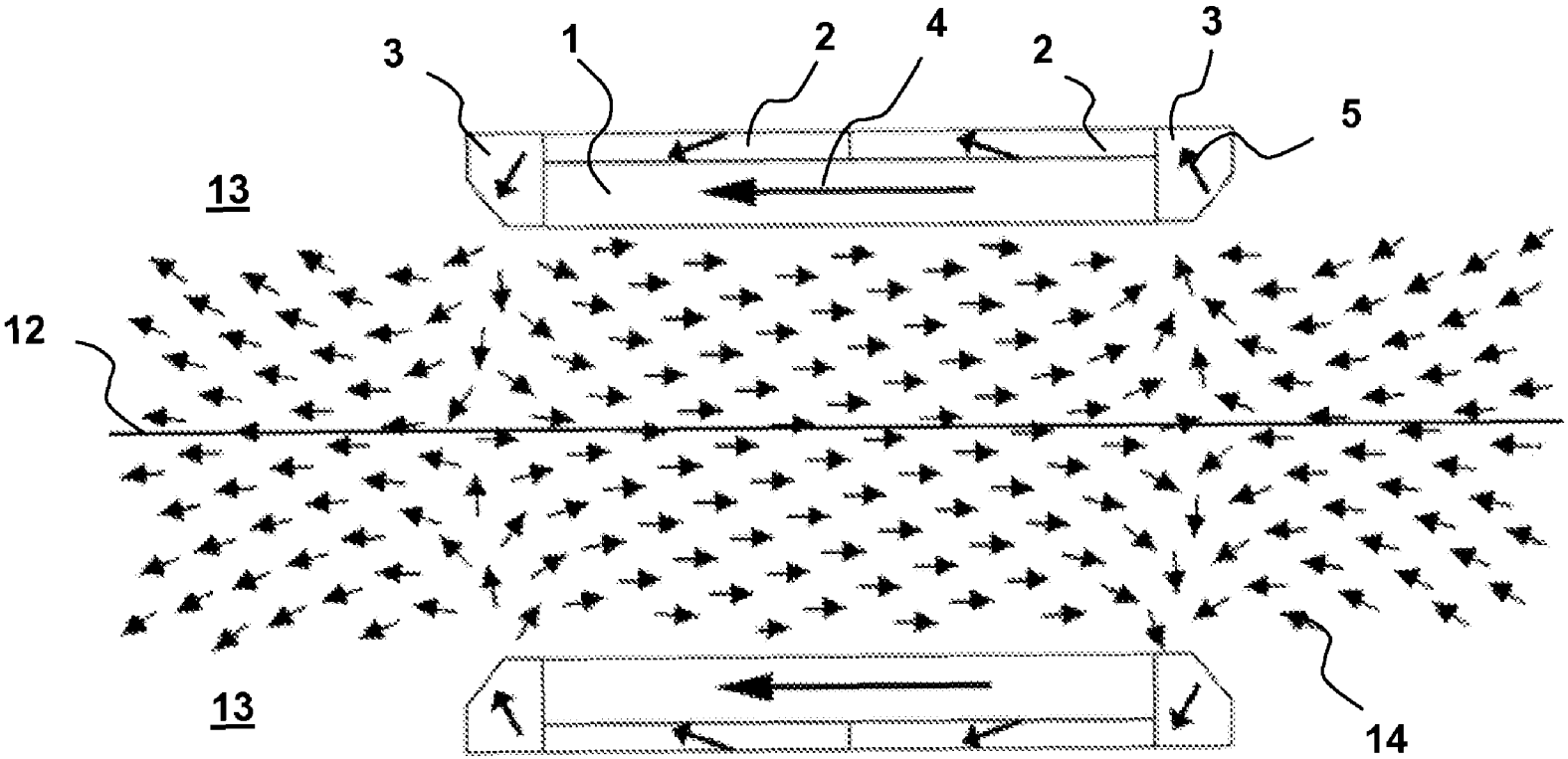
FIG. 4 is a vector field plot describing the directionality of the magnetic field within the active region of the permanent magnet solenoid.

A more detailed description of the directionality of the solenoidal field in the working space of the cylindrical shell is displayed in FIG. 4. The view presented in FIG. 4 is representative of a cross-sectional plane through the cylindrical shell assembly 10 of FIG. 2, with the plane including the longitudinal axis 12 of the cylinder, thus dividing the cylinder into two equal 180 degree arcs. Observable in the magnet assembly cross sections 13 are the base magnet 1, the cladding magnets 2 and 3, and arrows 4, 5 representing the approximate magnetization directions of the magnets intersecting the cross-sectional plane. The arrows 14 represent a two-dimensional vector field plot describing the direction of the magnetic field in the cross-sectional plane within the working region of the permanent magnet solenoid displayed in FIG. 2. It is important to note that the vector field 14 only indicates magnetic field directionality in the cross sectional plane within the working region of the permanent magnet, not the magnitude of said magnetic field. As can be observed in FIG. 4, magnetic nulls are formed near the two longitudinal ends of the magnet. These nulls are a natural result of the magnetic flux patterns imposed by the chosen magnetization directions of the permanent magnets forming the cylindrical shell. Thus, the working region of this type of permanent magnet structure will be confined to the region toward the longitudinal center of the magnet, away from the magnetic field nulls.

The existence of the magnetic field nulls at either end of the magnet can be especially advantageous for applications in which the existence of a confined charged particle beam is desired in only a given portion of a device like a microwave tube. If the charged particle is generated and utilized within the active region of the magnet, as it passes out of the active region and into the magnetic null, the beam will spread very rapidly due to electrostatic repulsion and diffuse into the wall of the beam pipe.

Figure 5:
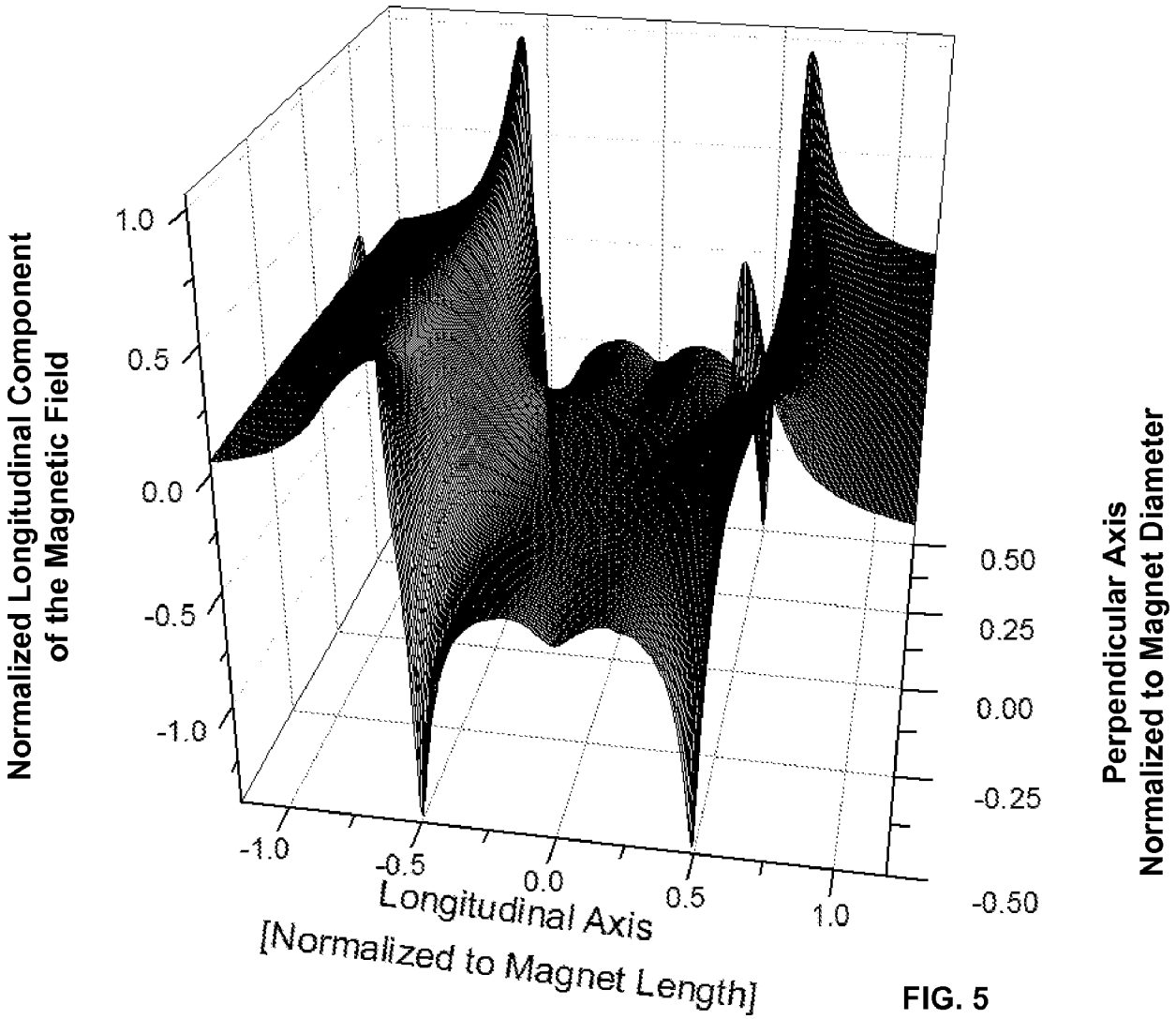
FIG. 5 is a three-dimensional contour plot of the longitudinally-directed magnetic field amplitude in a plane bisecting the permanent magnet solenoid observed in FIG. 2.

The three-dimensional surface plot displayed in FIG. 5 depicts the amplitude of the longitudinal component of the solenoidal magnetic field in a cross-sectional plane similar to that represented by vector field 14. The plotted data was obtained from a computational finite element simulation of a permanent magnet of the design displayed in assembly 10 of FIG. 2*b*, with a diameter to length aspect ratio of 1:2. The longitudinal axis is normalized to the length of the solenoid. Additionally, the zero mark on the longitudinal axis represents the longitudinal center of the magnet. The perpendicular axis, aligned along the magnet diameter at the center of the magnet working volume, is normalized to the diameter of the solenoid. The plot axis representing the amplitude of the longitudinal component of the magnetic field was normalized to the largest magnetic field amplitude observed in the simulation data. As is evident from the plotted data, the longitudinal component of the magnetic field is very uniform within the working region of the magnet. As longitudinal ends of the magnets are approached, the magnetic field rapidly approaches a null then reverses beyond the longitudinal limits of the solenoid.

Figure 6:
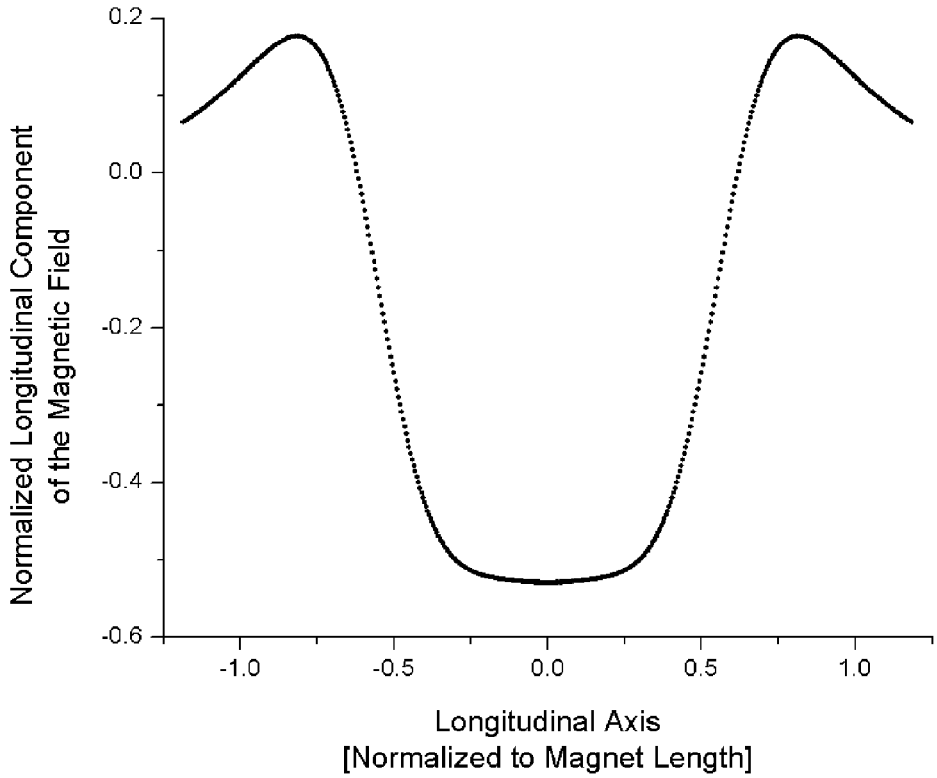
FIG. 6 is a plot of the longitudinally-directed magnetic field amplitude along the central axis of the permanent magnet solenoid observed in FIG. 2.

FIG. 6 shows a plot of the longitudinal component of the magnetic field along the axis of the solenoid. As was done with plot axis of FIG. 5, the plot axis of FIG. 6 representing the amplitude of the longitudinal component of the magnetic field was normalized to the largest magnetic field amplitude observed in the simulation data from which both FIG. 5 and FIG. 6 were derived. The plot axis representing longitudinal distance along the axis of the solenoid was normalized to the length of the solenoid. As is readily observable from the plot, the magnetic field profile along the solenoid axis within the working region of the solenoid is very flat. However, as one moves out of the working region toward either end of the solenoid, a magnetic field null is encountered, followed by a field reversal region.

Figure 7A:
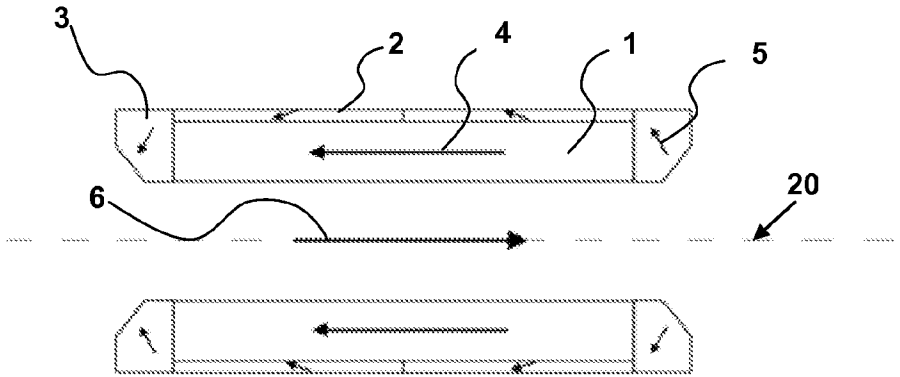
FIG. 7 shows another embodiment of the present invention in which cladded magnet subassemblies, similar in cross-section (7*a*) to the diagram depicted in FIG. 1, are used to make a parallel surface assembly (7*b*) that will generate a longitudinally-directed magnetic field.
Figure 7B:
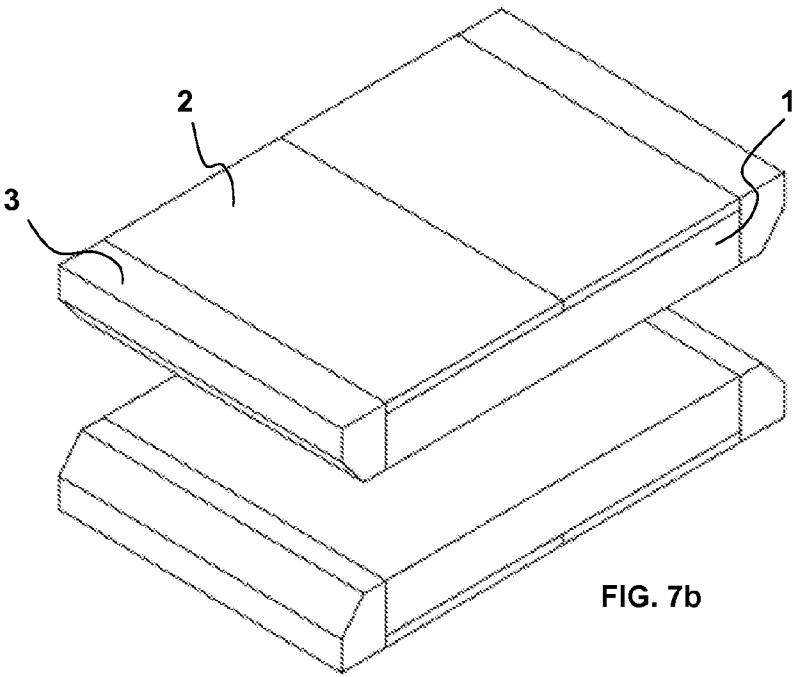

Another embodiment of the present invention, derived from the cross-section depicted in FIG. 1 is a parallel surface arrangement, displayed in FIG. 7*a*. The base magnets 1 are arranged such that they are parallel to each other on opposite sides of a plane of symmetry 20 and the cladding magnets 2 and 3 are arranged as depicted. Arrows show the approximate magnetization directions of the base 4 and cladding magnets 5 to yield the desired longitudinal magnetic field direction 6 within the working region of the magnet array. A three-dimensional view of the planar surface magnet arrangement is shown in FIG. 7*b*. Within the working region of the magnet, the magnetic field directionality in a cross section centered at the center of the magnet width will be similar to that shown in FIG. 4.

In other embodiments of the present invention, the base and cladding magnets may take on other shapes, such as polyhedrals with various geometric cross-sections which can also be assembled into a permanent magnet solenoid.

The invention claimed is:

1. A permanent magnet structure capable of generating a uniform magnetic field that is longitudinally directed, said magnet structure having a top and a bottom magnet subassembly, each subassembly comprised of:

a. a base magnet having a rectangular cross-section, an inner flat longitudinal surface parallel to an outer flat longitudinal surface, a flat south pole at one end and a flat north pole at the opposite end and a magnetic polarity in the longitudinal direction;

b. one or more first cladding magnets attached to and covering said outer flat longitudinal surface of said base magnet, having flat ends corresponding to the ends of said base magnet and having a polarity in the same direction as said base magnet;

c. second cladding magnets attached to and only covering each end of said base magnet and the ends of said first cladding magnets and having a polarity in the general direction of said base magnet polarity; and d. said top and bottom subassemblies arranged such that their inner flat longitudinal surfaces are parallel to each other with their base magnet polarities in the same direction and separated by a space, whereby said space between said subassemblies constitutes a working region containing a longitudinal magnetic field with a magnetic polarity opposite to that of said base magnet polarities.

2. The permanent magnet structure of claim 1, wherein said second cladding magnets have a beveled edge directed toward said working region.

3. A permanent magnet solenoid structure in the shape of a hollow cylindrical shell capable of generating a uniform magnetic field that is directed along the cylindrical axis of said solenoid structure and with unobstructed ends of said solenoid structure, said magnet solenoid structure being comprised of a plurality of similar subassemblies, each subassembly comprised of:

a. a base magnet having an inner surface defined by a straight longitudinal dimension and an arc of a circle dimension perpendicular to said longitudinal dimension and a corresponding parallel outer surface, a flat south pole at one end and a flat north pole at the opposite end and a magnetic polarity in the longitudinal direction;

b. one or more first cladding magnets attached to and covering said outer curved surface of said base magnet, having flat ends corresponding to the ends of said base magnet and having a polarity in the same direction as said base magnet;

c. second cladding magnets attached to and only covering each end of said base magnet and the corresponding ends of said first cladding magnets and having a polarity in the general direction of said base magnet polarity; and d. said plurality of curved subassemblies arranged in a hollow cylindrical shell pattern to form a solenoid structure, each subassembly having the base polarity in the same direction, whereby the hollow space within said solenoid structure constitutes an unobstructed working region containing a uniform longitudinal magnetic field with a magnetic polarity opposite to that of said base magnet polarities.

4. The permanent magnet solenoid structure of claim 3, wherein said second cladding magnets have a beveled edge directed toward said working region.

* * * * *